US005412164A

United States Patent [19]

Conway et al.

[11] Patent Number: 5,412,164

[45] Date of Patent: May 2, 1995

[54] DUAL ACTION SWITCH ASSEMBLY WITH SEQUENTIALLY ACTUATED MEMBRANE SWITCHES INCLUDING A RECIPROCATING CIRCUIT BOARD

[75] Inventors: Michael E. Conway, Youngstown; Samuel E. Penn, Cortland, both of Ohio

[73] Assignee: General Motors Corporation, Detroit, Mich.

[21] Appl. No.: 161,008

[22] Filed: Dec. 3, 1993

[51] Int. Cl.[6] ..... H01H 3/02; H01H 9/00; H01H 13/70

[52] U.S. Cl. ..... 200/1 B; 200/5 A; 200/17 R; 200/18; 200/517

[58] Field of Search ..... 200/1 R-1 TK, 200/5 R, 5 A, 11 R-11 TW, 17 R, 18, 512-517, 339

[56] References Cited

U.S. PATENT DOCUMENTS 4,471,177 9/1984 Doughty ..... 200/5 A
4,771,139 9/1988 De Smet ..... 200/5 A
4,977,298 12/1990 Fujiyama ..... 200/5 A
5,294,758 3/1994 Frankhouse et al. ..... 200/5 R

*Primary Examiner*—J. R. Scott
*Attorney, Agent, or Firm*—William A. Schuetz

[57] ABSTRACT

A two-way dual action electric switch assembly has an actuator that slides in housing from a neutral position to a first position to a second position and back to the neutral position in each direction. Travelling circuit boards are slideably disposed in the housing on either side of the actuator and a single elastomeric dome switch is disposed between the actuator and each travelling circuit board. A fixed circuit board is outboard of each travelling circuit board and a pair of second elastomeric dome switches are disposed between each travelling circuit board and its associated fixed outboard circuit board. The single elastomeric dome switches close electric circuitry of the travelling circuit boards in the first positions and the pairs of second elastomeric dome switches close electric circuitry of the fixed outboard circuit boards in the second positions.

10 Claims, 3 Drawing Sheets

DUAL ACTION SWITCH ASSEMBLY WITH SEQUENTIALLY ACTUATED MEMBRANE SWITCHES INCLUDING A RECIPROCATING CIRCUIT BOARD

BACKGROUND OF THE INVENTION

This invention relates generally to electric switch assemblies and more particularly to a dual action electric switch assembly.

A dual action electric switch assembly may be used to control devices that have two modes of related operations such as automobile windows and sunroofs that have conventional and express opening or closing modes.

In such an application, an actuator is moved to a first position to operate a first switch so that the device operates in a first or conventional manner. That is, the window or sunroof opens or closes at a steady pace and stops when the actuator is returned to a neutral starting position. The actuator can also be moved past the first position to a second position to operate a second switch so that the device operates in a second or express mode where the window or sunroof travels very quickly to a fully open or fully closed position.

SUMMARY OF THE INVENTION

The object of this invention is to provide a dual action switch assembly that is simple in construction and has few moving parts.

A feature of the invention is that the dual action switch assembly incorporates elastomeric dome switches in a unique arrangement that automatically signals when a first position closing a first switch for a first mode of operation is reached.

Another feature of the invention is that the dual action switch assembly incorporates a travelling circuit board that is moved from the first position to a second position closing a second switch or set of switches for a second mode of operation.

Still another feature of the invention is that the dual action switch assembly incorporates elastomeric dome switches in an arrangement that eliminates any need for detentes and/or return springs other than the elastomeric domes themselves.

Still another feature of the invention is that the dual action switch assembly incorporates a triangular arrangement of identical elastomeric dome switches for balanced operation and economical manufacture.

Still yet another feature of the invention is that a two-way dual action switch assembly for controlling four modes or operation or functions is easily provided by a symmetrical duplication of parts.

BRIEF DESCRIPTION OF THE DRAWINGS

The above and other objects, features and advantages of the invention will become more apparent from the following description taken in conjunction with the accompanying drawings wherein like references refer to like parts and wherein.

DESCRIPTION OF THE INVENTION

Figure 3:
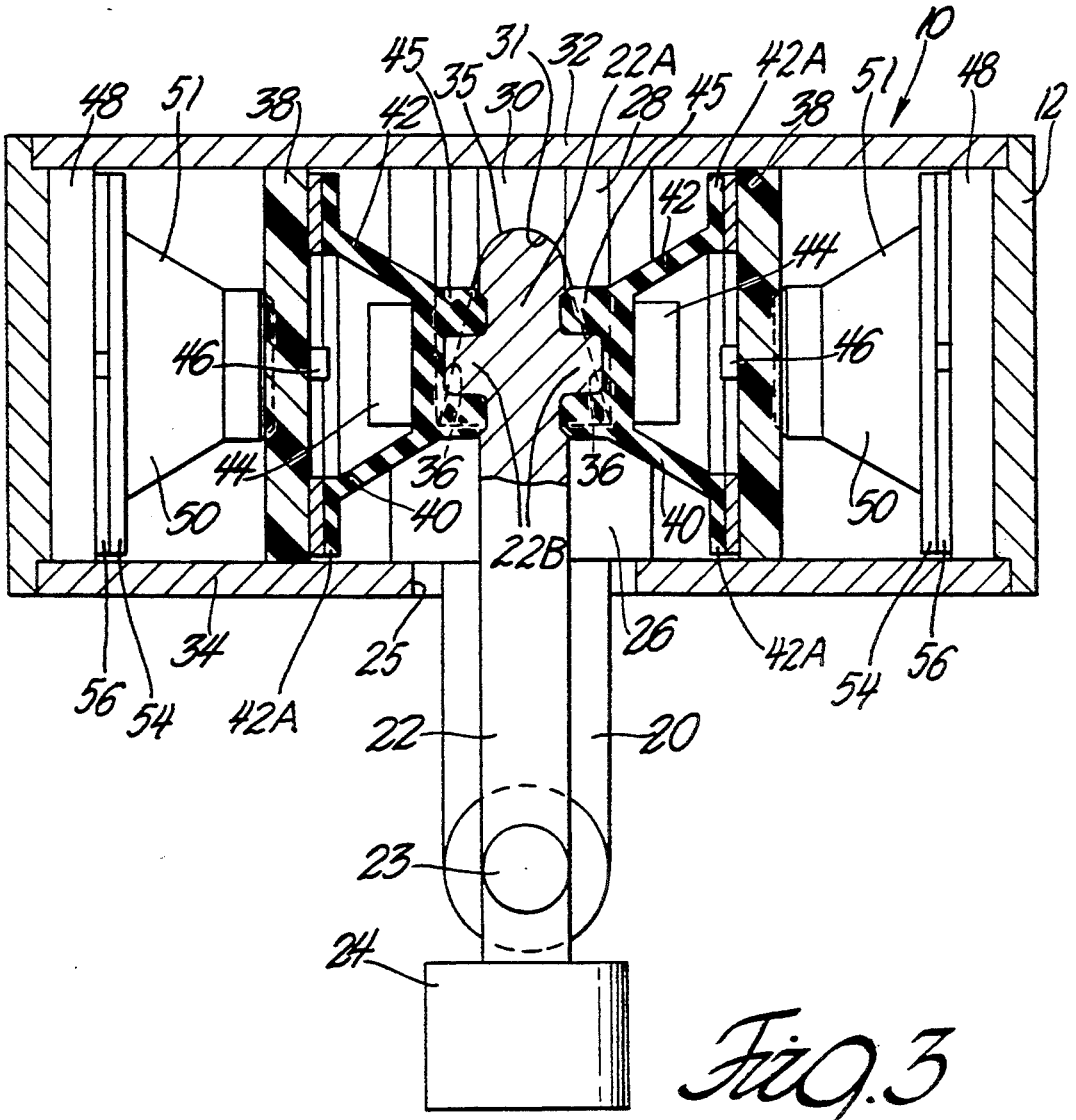
FIG. 3 is a section taken substantially along the line 3—3 of FIG. 2 looking in the direction of the arrows but showing the covers in place.

Referring now to the drawings a two-way version of a dual action switch assembly of the invention is indicated generally at 10. It comprises a rectangular housing 12 having four side walls 14. Two opposite side walls 14 have bosses 16 that project into the interior space of the housing to serve as a lateral guide for an actuator 18. The bosses 16 also have depending arms 20 that extend below the side walls 14 as best shown in FIG. 3. The arms 20 pivotally support pivot pins 23 of a rocker or lever 22 for moving the actuator 18 back and forth in the housing 14. As shown in FIG. 3, the rocker 22 extends through an enlarged opening 25 in a bottom or cover 34 for the housing 12 so that it can be pivoted. The lower end of the rocker 22 has a switch button or key cap 24 for pivoting the rocker 22 about its pivot 23.

Figure 1:
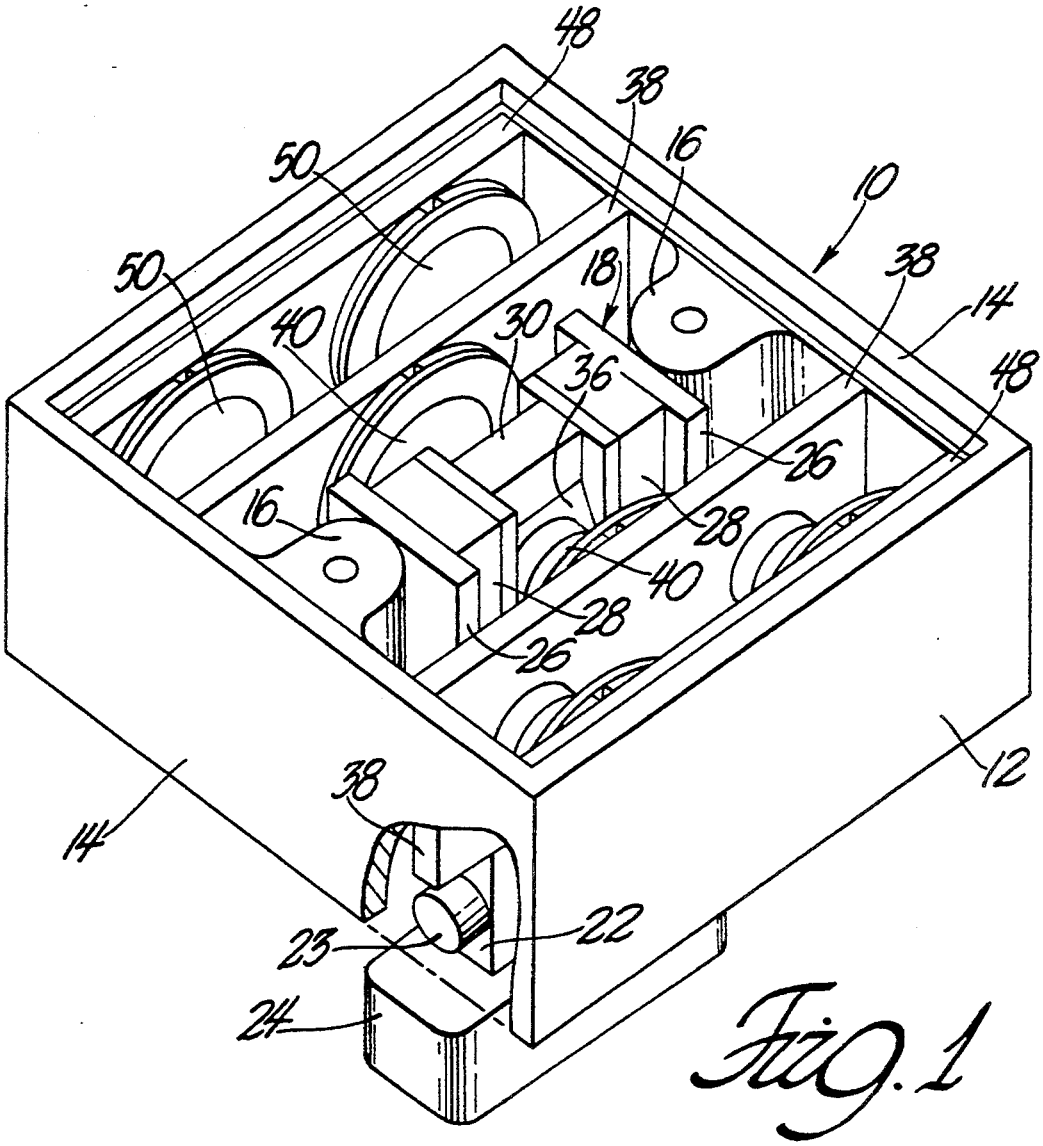
FIG. 1 is a perspective view of a two-way dual action switch assembly of the invention with the housing covers removed to show internal detail.
Figure 2:
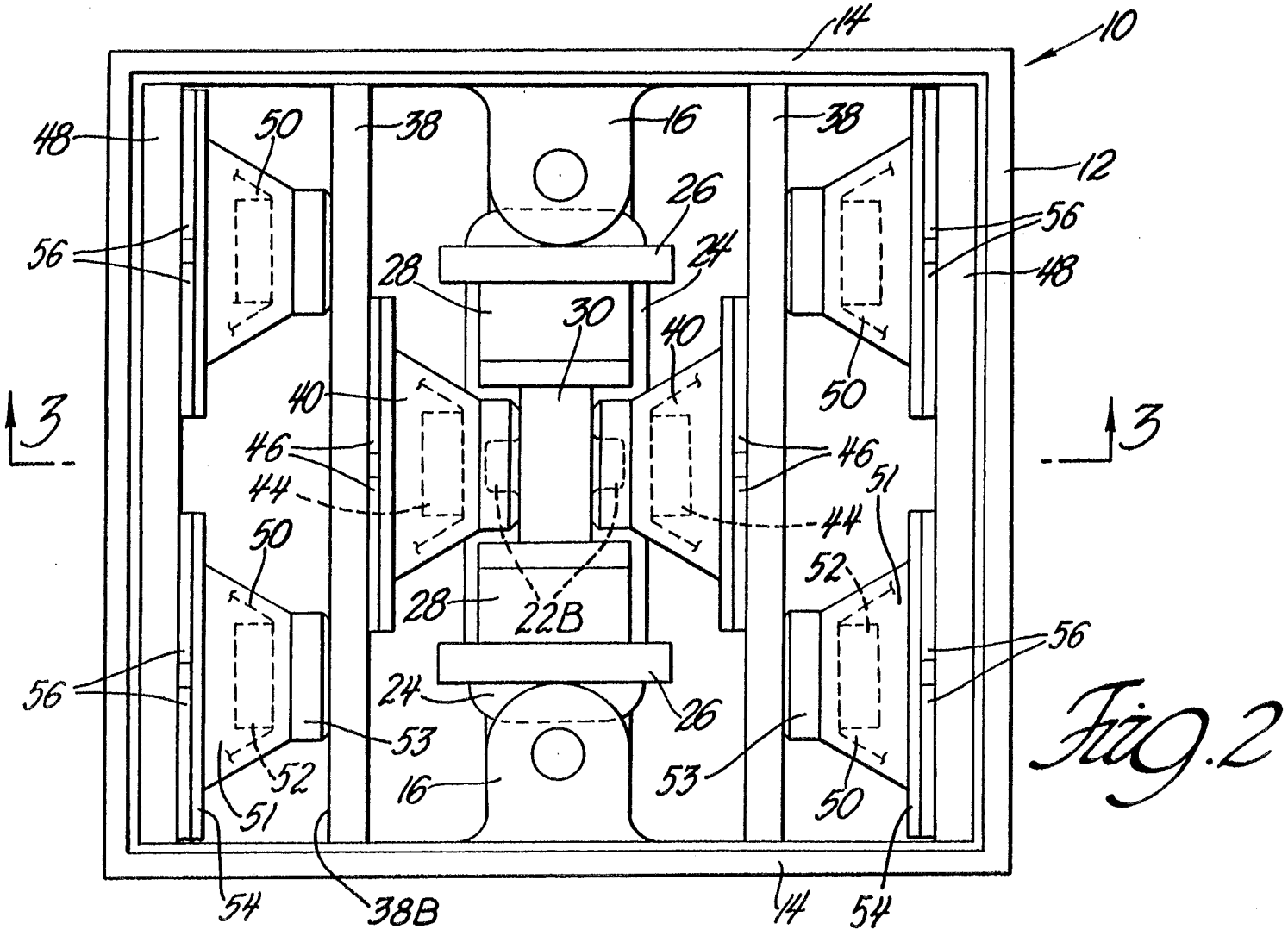
FIG. 2 is a top view of the uncovered switch assembly that is shown in FIG. 1.

The actuator 18 which is shown in perspective in FIG. 1 can be a multi-piece weldment or a one piece machined part. It comprises two outer rectangular slide plates 26, two intermediate stop plates 28 of reduced size as compared to the slide plates 26, and a cross bar 30. The height of the outer slide plates 26 matches the depth of the housing 14 so that the slide plates 26 slide in the housing 14 on covers 32 and 34 for the housing 12 when the covers 32 and 34 are in place as shown in FIG. 3. As best shown in FIGS. 2 and 3, the intermediate stop plates 28 and the cross bar 30 have aligned curved grooves 31 that receive an upper rounded end 35 of the rocker 22 so that the actuator 18 slides in the housing 12 when the rocker 22 is pivoted about its pivot 23. The curved grooves 31 in the stop plates 28 are contiguous with or include diverging side wall surfaces 36 in the stop plates 28 that function as stops to limit pivotal movement of the rocker 22 by contacting side margins of the rocker 22.

The dual action switch assembly 10 further comprises two rectangular travelling circuit boards 38 on either side of the actuator 18. The height of the travelling circuit boards 38 also matches the depth of the covered housing 14 so that the travelling circuit boards 38 also slide in the housing 12 on the covers 32 and 34.

An elastomeric dome switch 40 is centrally positioned in the housing 12 and between a top part 22A of the rocker 22 and each of the respective travelling circuit boards 38. The elastomeric dome switches 40 are conventional and comprise an elastomeric dome 42 and an inside electrical conductor button 44 at the top 45 of the elastomeric dome. The top 45 of each elastomeric dome 42 defines an exterior hollow or annular hub which tightly engages a protrusion 22B on the top of the rocker 22 when the rocker 22 is in a neutral position as shown in FIG. 3. The foot 42A of each dome 42 is fastened to its associated travelling circuit board 38 as also shown in FIG. 3. This arrangement permits the dome switches 40 and travelling circuit boards 38 to be manufactured as two subassemblies. It also provides another advantage in a two way arrangement as explained below.

Figure 4:
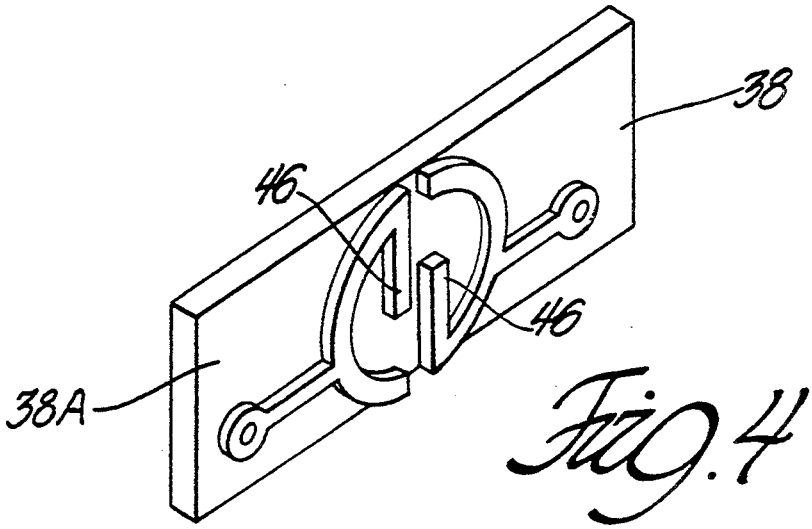
FIG. 4 is a perspective view of a typical travelling circuit board component of the switch assembly.
Figure 5:
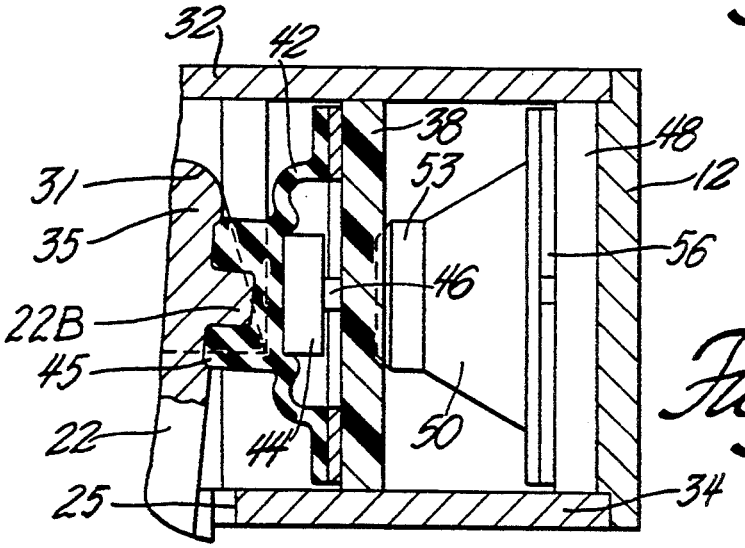
FIG. 5 is a portion of FIG. 3 showing components of the switch assembly in a first operating position.

The typical left hand circuit board 38 is shown in FIG. 4. It comprises an electrically insulative substrate 38A that supports a conductive electric circuit on its surface. The circuit includes a pair of spaced electrical contacts 46 that are bridged when the elastomeric dome 42 is collapsed and the inside electrical conductor button 44 engages the contacts 46 as shown in FIG. 5. Elastomeric dome switches are collapsed by a well defined force and provide a clear tacit feel to the operator when the dome is collapsed.

The dual action switch assembly 10 further comprises two fixed circuit boards 48 that are outboard of the respective travelling circuit boards 38 and fixed to the housing 12. Two elastomeric dome switches 50 are positioned between each travelling circuit board 38 and its associated fixed outboard circuit board 48. The two dome switches 50 associated with each pair of travelling and outboard circuit boards are equally spaced laterally from the single dome switches 40 so that the travelling circuit boards 38 are supported in a balanced manner.

The elastomeric dome switches 50 are conventional and preferably identical to the dome switches 40. Each comprises an elastomeric dome 51 and an inside electrical conductor button 52 at the top 53 of the elastomeric dome (see FIG. 3). The top 53 of each elastomeric dome 51 engages the bottom side 38B of the its associated traveling circuit board 38 when the actuator 18 is in the neutral position and the foot 54 of each dome is fastened to the associated outboard circuit board 48 as shown in FIG. 3. This arrangement also permits the dome switches 50 and circuit boards 48 to be made as two subassemblies to facilitate manufacture. The use of the four subassemblies allows the actuator 18 to move away from the two nonactive subassemblies when it is moved so that the outboard circuit boards 48 can be fixed in the housing 12 in a two-way switch assembly.

The typical circuit board 48 includes one or two pairs of spaced electrical contacts 56 such as the pair of spaced contacts 46 of the circuit board 38 that is shown in FIG. 4 depending on circuit requirements. If two pairs of spaced electrical contacts 56 are used, both pairs are bridged when the elastomeric domes 51 of the dome switches 50 are collapsed and the inside electrical conductor buttons 52 engage the respective pairs of contacts. If one pair of contacts 56 is used, one dome switch 50 is fully functional while the other dome switch 50 is a dummy for balanced support of the travelling circuit board 38.

The two-way dual action switch 10 operates as follows. For operating the automobile window or sunroof in a first mode, such as for a conventional opening, the rocker 22 is pivoted clockwise from the neutral position shown in FIG. 3, moving or translating the actuator 18 to the right until the elastomeric dome 42 of the right hand dome switch 40 collapses and the pair of contacts 46 of the right hand travelling circuit board 38 are closed by being bridged by contact 44 as shown in FIG. 5. The collapse provides a tacit feel to the operator indicating that the required level of force has been applied. The travelling circuit board 38 is detained or kept in this first operating position by the two dome switches 50 between the right hand travelling circuit board 38 and the right hand fixed outboard circuit board 48 which require twice as much additional force to collapse the two dome switches 50. Dome switches 50 need not be identical to dome switches 40 and a different number of dome switches 50 can be used so long as it takes considerably more force to collapse the two outer dome switches 50 than it does to collapse the single inner dome switch 40. The force requirements are also preferably chosen so that there is not any significant collapse of the two outer dome switches 50 when the dome switch 40 is collapsed. The most efficient and economical arrangement is the triangular arrangement of three identical dome switches illustrated in FIGS. 1 through 5.

In any event the window or sunroof opens at a steady pace when the inner dome switch 40 is collapsed to close suitable control circuitry including that of the travelling circuit board 38. In this conventional mode of operation, the window or sunroof can be stopped at any partially open position by releasing the rocker 22 so that the actuator 18 is returned to the neutral position and the conductor button 44 is moved away from the pair of contacts 46 by the elastomeric dome 42.

For operating the automobile window or sunroof in a second mode, such as an express opening, the rocker 22 is pivoted clockwise from the neutral position in FIG. 3, past the first position described above to a second position where all of the elastomeric domes in the three right hand switches 40 and 50 are collapsed. This bridges all associated pairs of contacts 46, 56 of the right hand circuit boards 38 and 48, respectively. This causes the window or sunroof to open at a very rapid rate through suitable control circuitry including the electrical circuitry of the two circuit boards 38 and 48 until the window or sun roof is fully open. The actuator 18 is returned to the neutral position by releasing the rocker lever 22 and allowing the three elastomeric domes to return the travelling circuit board 38 and the actuator 18 to the neutral position shown in FIG. 3.

For closing the window or sunroof in a conventional manner, the rocker 22 is pivoted counterclockwise moving the actuator 18 to a first left hand position to collapse the left hand dome switch 40 and close suitable control circuitry associated with the left hand circuit board 38. Similarly, the window or sunroof is closed in an express manner by pivoting the rocker counterclockwise to move the actuator 18 past the first left hand position until the left hand travelling circuit board 38 collapses the two left hand dome switches 50 and closes suitable control circuitry associated with the left hand out board circuit board 48.

While specific functions of a specific application have been described for purposes of illustration, it should be understood that the functions and the application may be changed. For instance, opening of a door or sunroof can be accomplished by pivoting the rocker 22 counterclockwise and closing by pivoting the rocker 22 clockwise. Also the positions for conventional and express modes of operation can be reversed so that window or sunroof is operated in an express mode at the first right hand or left hand position. Moreover the switch assembly 10 can be used in other applications. In its broadest sense, the dual action electric switch assembly of this invention contemplates the control of any two functions with a one-way dual action switch assembly or of any four functions with a two-way dual action switch assembly.

In other words, the invention has been described in an illustrative manner, and it is to be understood that the terminology which has been used is intended to be in the nature of words of description rather than of limitation.

Obviously, many modifications and variations of the present invention in light of the above teachings may be made. It is, therefore, to be understood that, within the scope of the appended claims, the invention may be practiced otherwise than as specifically described.

The embodiments of the invention in which an exclusive property or privilege is claimed are defined as follows:

1. A dual action electric switch assembly comprising, a housing, an actuator supported by said housing for movement back and forth between neutral, first and second positions in the housing, a travelling circuit board supported by said housing for movement relative thereto, a first elastomeric dome switch disposed between the actuator and the travelling circuit board and secured to one of said actuator and travelling circuit board, a second circuit board outboard of the travelling circuit board, and a plurality of second elastomeric dome switches carried by said second circuit board disposed between said travelling circuit board and the second circuit board, said actuator collapsing said first dome switch while said second dome switches hold said travelling circuit board against movement when the actuator is moved from its neutral to its first position, said actuator when moved from its first position to its second position causing said travelling circuit board to move and collapse said second dome switches.

2. The dual action electric switch assembly as defined in claim 1 wherein the second plurality of elastomeric dome switches consist of a pair of elastomeric dome switches that are equally spaced laterally from said first dome switch and identical to the first dome switch.

3. The dual action electric switch assembly as defined in claim 1 further including:

a second travelling circuit board movably disposed in the housing on an opposite side of the actuator, a third elastomeric dome switch disposed between the actuator and the second travelling circuit board, a third circuit board outboard of the second travelling circuit board, and a plurality of fourth elastomeric dome switches carried by said third circuit board and disposed between second travelling circuit board and the third circuit board.

4. The dual action electric switch assembly as defined in claim 3 wherein the first and third outboard circuit boards are fixed in the housing.

5. The dual action electric switch assembly as defined in claim 4 wherein the dome switches and their associated circuit boards are subassemblies.

6. A dual action electric switch assembly comprising, a housing, an actuator that is slidably supported by the housing for movement between a neutral position to a first position, to a second position and back to the neutral position, a travelling circuit board slideably supported by the housing for movement relative thereto between first and second positions, a first elastomeric dome switch carried by the travelling circuit board and disposed between the actuator and the travelling circuit board, a second circuit board outboard of the travelling circuit board, a pair of second elastomeric dome switches carried by said second circuit board and disposed between the travelling circuit board and the second circuit board, and the pair of second elastomeric dome switches having sufficient mechanical resistance to detain the travelling circuit board in its first position while the first elastomeric dome switch is collapsed to close electric circuitry of the travelling circuit board and the pair of dome switches do not collapse to close any electric circuitry on the second circuit board in response to movement of the actuator from its neutral toward its first position, said travelling circuit board being moved from its first position toward its second position in which it collapses the second pair of elastomeric dome switches to close electric circuitry on the second circuit board in response to movement of the actuator from its first toward its second position.

7. A dual action electric switch assembly comprising, a housing, an actuator that is slidably supported by the housing for movement from a neutral position to a first position, to a second position and back to the neutral position, a travelling circuit board disposed in the housing and slideably supported by the housing for movement relative thereto, a first elastomeric dome switch carried by the travelling circuit board and centrally disposed in said housing and disposed between the actuator and the travelling circuit board for closing control circuitry of the travelling circuit board when dome switch is collapsed in response to movement of the actuator from its neutral position toward its first position, a second circuit board outboard of the travelling circuit board, a pair of second elastomeric dome switches carried by the second circuit board and equally spaced laterally of the first elastomeric dome switch and disposed between travelling circuit board and the second circuit board for closing electric circuitry of the second circuit board, and the pair of second elastomeric dome switches having sufficient mechanical resistance to detain the travelling circuit board against movement while the first elastomeric dome switch is collapsed to close electric circuitry of the travelling circuit board and the pair of dome switches are not collapsed to close any electric circuitry of the second circuit board in response to movement of the actuator from its neutral position to its first position, said actuator when moved from its first position toward its second position causing said travelling circuit board to move relative to said housing and collapse said second elastomeric dome switches to close the electric circuitry on said second circuit board.

8. The dual action electric switch as defined in claim 7 herein the first elastomeric dome switch and the pair of second elastomeric dome switches are identical.

9. The dual action electric switch assembly as defined in claim 7 wherein the second outboard circuit board is fixed in the housing.

10. The dual action electric switch assembly as defined in claim 9 wherein the dome switches and their associated circuit boards are subassemblies.

* * * * *